United States Patent [19]

Parsons, Sr.

[11] 4,202,284

[45] May 13, 1980

[54] SEWING MACHINE TABLE

[76] Inventor: Joe T. Parsons, Sr., P.O. Box 445, Osceola, Ark. 72370

[21] Appl. No.: 974,344

[22] Filed: Dec. 29, 1978

[51] Int. Cl.[2] ..... D05B 75/02

[52] U.S. Cl. ..... 112/217.1; 108/96; 108/132; 312/30

[58] Field of Search ..... 108/96, 144, 132, 136; 112/217.1, 258; 312/30, 21, 29

[56] References Cited

U.S. PATENT DOCUMENTS

| | | | |
|---|---|---|---|
| 560,380 | 5/1896 | Troyke | 312/29 |
| 885,748 | 4/1908 | Haggard | 108/106 X |
| 1,050,324 | 1/1913 | Wyckoff | 312/29 |
| 1,433,162 | 10/1922 | Sweetland | 108/106 X |
| 2,976,094 | 3/1961 | Scherer | 108/106 |
| 3,094,080 | 6/1963 | Shannon | 108/144 |
| 3,870,386 | 3/1975 | Shepherd | 312/30 |
| 3,993,008 | 11/1976 | Parsons, Sr. | 112/217.1 |
| 4,089,573 | 5/1978 | Aeschliman | 312/21 |

FOREIGN PATENT DOCUMENTS

| | | | |
|---|---|---|---|
| 250194 | 3/1964 | Australia | 108/132 |

*Primary Examiner*—Francis K. Zugel

[57] ABSTRACT

A table for supporting an object such as a free-arm sewing machine and for allowing the object supported thereby to be adjusted heightwise relative to the work surface of the table. The table includes a platform member for bearing the object. The platform member is adjustable heightwise relative to the work surface of the table between a first position substantially even with the work surface of the table and infinite positions below the work surface of the table. At least one of the infinite positions of the platform member is positively defined by a stop member to allow the platform member to be readily moved between the first position and the position defined by the stop member.

8 Claims, 13 Drawing Figures

FIG.4
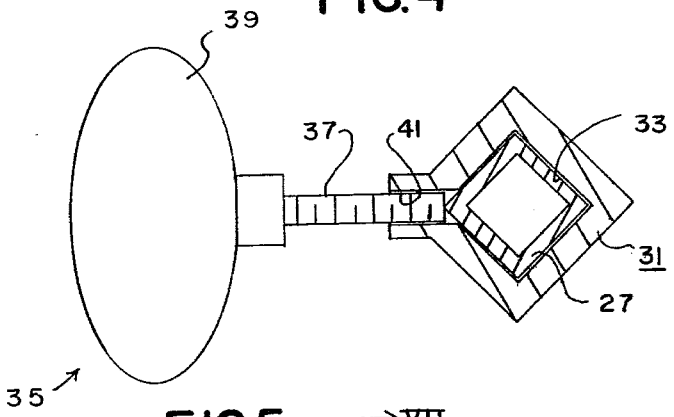
FIG.5
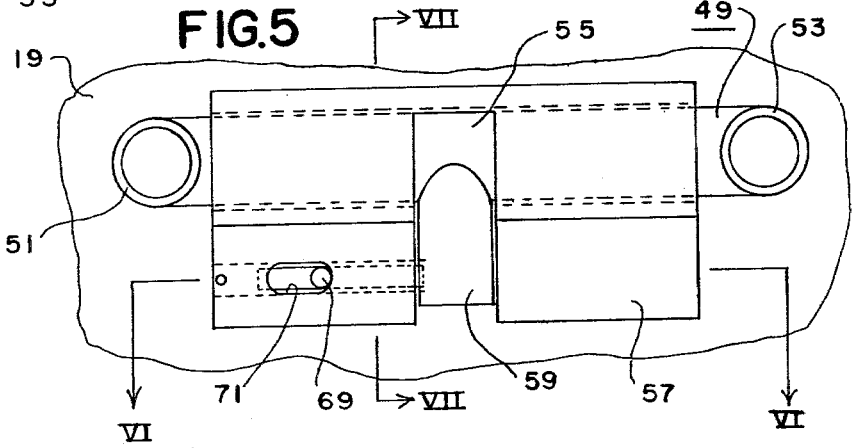
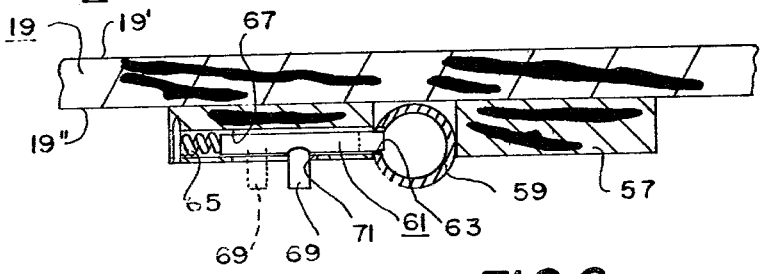
FIG.6

SEWING MACHINE TABLE

BACKGROUND OF THE INVENTION

1. Field of the Invention

This invention relates generally to tables and more specifically to tables for movably supporting free-arm sewing machine.

2. Description of the Prior Art

Heretofore, various tables for movably supporting sewing machines have been developed. See, for example, Shepherd, U.S. Pat. No. 3,870,386; Parsons, U.S. Pat. No. 3,993,008; and Italian Pat. No. 498,884. None of the above patents disclose or suggest the present invention.

The Shepherd patent discloses a table for supporting a free-arm sewing machine which utilizes a pair of leaf springs to urge a platform upon which the sewing machine rests to a position substantially level with the work surface of the table. The platform can be moved to a predetermined second position by applying pressure against the pair of leaf springs until a lock mechanism is engaged to hold the platform in the predetermined second position. The Parsons patent discloses a table for supporting a free-arm sewing machine which utilizes an electric motor for moving the sewing machine between a concealed position and at least one working position. The Italian patent discloses a table for supporting a sewing machine which utilizes a lazy tong type mechanism for moving the sewing machine between an in-use position and a concealed position.

SUMMARY OF THE INVENTION

The present invention is directed towards improving upon prior tables for supporting objects such as free-arm sewing machines. The concept of the present invention is to provide such a table with a simple and efficient mechanism for allowing the object supported thereby to be adjusted heightwise relative to the work surface of the table. The table of the present invention includes, in general, a top member having an opening therethrough; a secondary member disposed beneath the top member a space apart distance; means for fixedly attaching the top member and the secondary member to one another; a platform member having a size and shape complimentary with the openinng in the top member for movement between a first position with the top surface of the platform member substantially horizontally aligned with the top surface of the top member and infinite positions with the top surface of the platform member spaced beneath the top surface of the top member; lock means for locking the platform means in any of the first or infinite positions; spring means for urging the platform member to the first position; and alignment means for maintaining the platform member in vertical alignment with the opening in the top member.

BRIEF DESCRIPTION OF THE DRAWINGS

FIG. 4 is a sectional view as taken on line IV—IV of FIG. 3.

FIG. 5 is a bottom plan view of a portion of the table of the present invention.

FIG. 6 is a sectional view as taken on line VI—VI of FIG. 5.

DESCRIPTION OF THE PREFERRED EMBODIMENT

Figure 1:
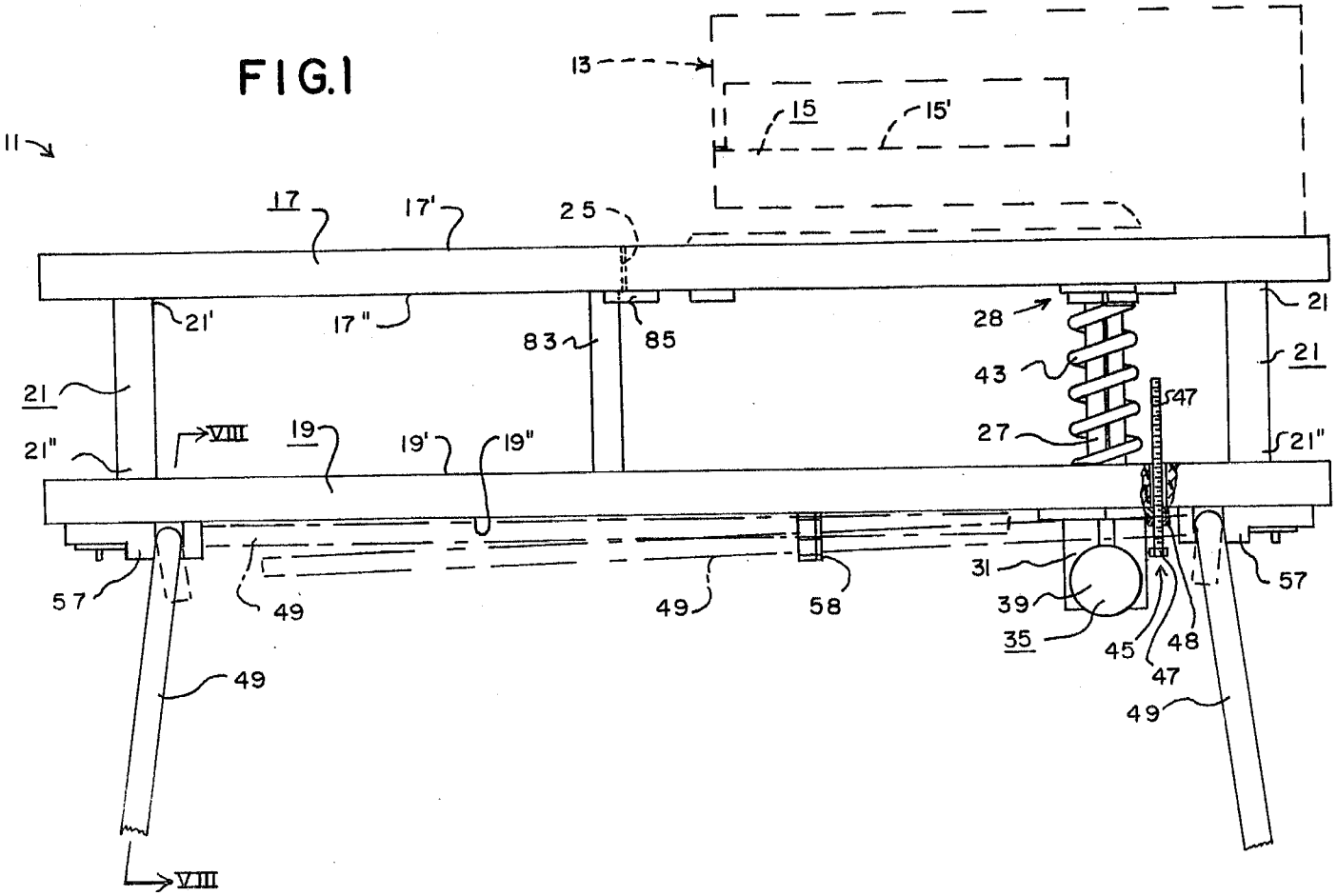
FIG. 1 is a side elevational view of the table of the present invention.

The table 11 of the present invention is for supporting an object such as a free-arm sewing machine 13 and for allowing the object supported thereby to be adjusted heightwise relative to the work or top surface of the table 11. The free-arm sewing machine 13 includes a free-arm member 15 having a substantially flat upper surface 15' on which the sewing operation is performed. The table 11 includes, in general, a top member 17, a secondary member 19 disposed beneath the top member 17 a space apart distance, means such as the post members 21 for fixedly attaching the top member 17 and the secondary member 19 to one another, and a platform member 23 for bearing the sewing machine 13 (see, in general, FIGS. 1 and 2).

Figure 9:
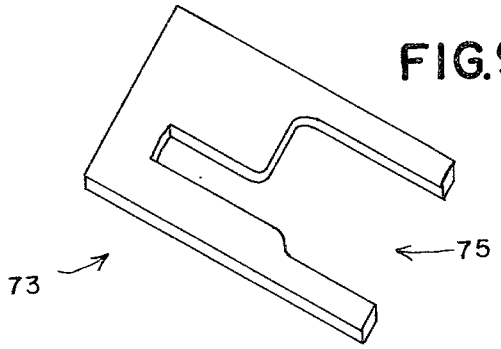
FIG. 9 is a pictorial view of a fill member of the table of the present invention.

The top member 17 has a top or working surface 17' and a bottom surface 17''. An opening 25 is provided through the top member 17. The opening 25 is of a size and shape which allows the sewing machine 13 to pass therethrough (see, in general, FIG. 9). The opening 25 is preferably adjacent one end of the top member 17 as clearly shown in FIGS. 9 and 10. The top member 17 may be constructed in any manner and of any substantially rigid material such as wood as will be apparent to those skilled in the art.

The secondary member 19 has a top surface 19' and a bottom surface 19''. The secondary member 19 is preferably substantially the same size and shape as the top member 17 but without an opening like the opening 25 therethrough. The secondary member may be constructed in any manner and of any substantially rigid material such as wood as will be apparent to those skilled in the art.

The top member 17 and the secondary member 19 may be fixedly attached to one another in any manner apparent to those skilled in the art. For example, the post members 21 may be utilized. Each post member 21 may have a first end 21' fixedly attached to the bottom surface 17' of the top member 17 by way of glue, screws or the like and may have a second end 21'' fixedly attached to the top surface 19'' of the secondary member 19 by way of glue, screws or the like. The secondary member 19 will thus be fixedly attached beneath the top member 17 a space apart distance substantially equal to the height of the post members 21. The post members 21 may be constructed in any manner and of any substantially rigid material such as wood as will be apparent to those skilled in the art.

The platform member 23 has a size and shape substantially complimentary with the opening 25 in the top member 17. More specifically, the platform member 23 is of a size and shape which will allow the sewing machine to rest there upon and be raised and lowered within the opening 25. The platform member 23 has a top surface 23' and a bottom surface 23''. The platform member 23 is adapted for movement between a first position with the top surface 23' substantially horizontally aligned with the top surface 17' and infinite positions with the top surface 23' spaced beneath the top surface 17'. The platform 23 may be constructed in any manner and of any substantially rigid material such as wood as will be apparent to those skilled in the art.

Figure 3:
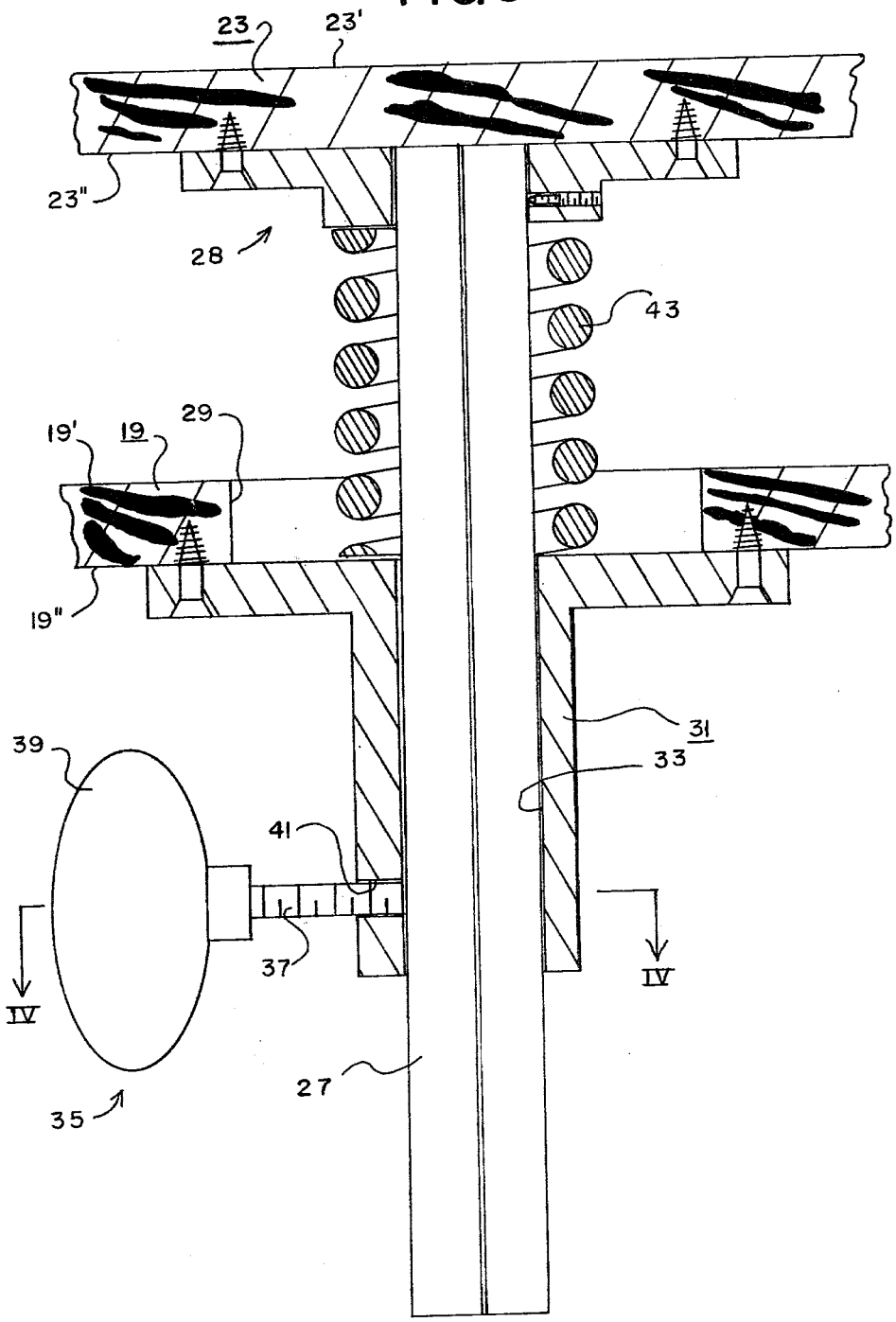
FIG. 3 is a sectional view as taken on line III—III of FIG. 2.

The table 11 includes an alignment means for maintaining the platform member 23 in vertical alignment with the opening 23 in the top member 17 (see, in general, FIG. 3). The alignment means preferably includes a post member 27 fixedly attached to the bottom surface 23'' of the platform member 23 and depending downwardly therefrom. The post member 27 may be attached to the platform member 23 in any manner apparent to those skilled in the art such as by way of the screw-flange assembly 28 clearly shown in FIG. 3. The secondary member 19 has an aperture 29 therethrough for allowing the post member 27 to extend therethrough. The alignment means preferably includes a collar member 31 attached to the bottom surface 19'' of the secondary member 19. The collar member 31 has an aperture 33 therethrough for allowing the post member 27 to slidably extend therethrough. The collar member 31 may be attached to the secondary member 19 in any manner apparent to those skilled in the art such as by screws or the like. The apertures 29, 33 through the secondary member 19 and the collar member 31 are vertically aligned with one another and are slightly larger in cross sectional area than the post member 27 to thereby allow the post member 27 to slidably pass therethrough while the post member 27 is maintained in a substantially vertical alignment thereby maintaining the platform member 23 in substantial vertical alignment with the opening 25 in the top member 17. It should be noted that the aperture 29 may be substantially larger in cross sectional area than the post member 27 as shown in FIG. 3 so long as the aperture 33 is only slightly larger in cross sectional area than the post member 27 to prevent the platform member 23 from being misaligned with the opening 25. The post member 27 and aperture 33 are preferably substantially square in cross sectional area (see FIG. 4).

The table 11 includes a lock means for locking the platform member in any of the first or infinite positions. The lock means preferably includes a hand screw member 35 for extending through the collar member 31 and for selectively engaging the post member 27 to thereby prevent the post member 27 from moving relative to the collar member 31 thereby locking the platform member 23 in any of the first or infinite positions (see, in general, FIGS. 3 and 4). The hand screw member 35 preferably includes a threaded body portion 37 and a handle portion 39. The threaded body portion 37 is screwably attached to the collar member 31 through a threaded aperture 41 therein and is fixedly attached to the handle portion 39 in any manner apparent to those skilled in the art such as by way of glue or the like. Then handle portion 39 is utilized to manually screw the threaded body portion 37 through the threaded aperture 41 and against the post member 27 as clearly shown in FIGS. 3 and 4 to thereby prevent the post member 27 from moving relative to the collar member 31. The table 11 includes a spring means 43 for urging the platform member 23 to the first position (see, in general, FIG. 3). The spring means 43 is preferably position about the post member 27 and between the bottom surface 23'' of the platform member 23 and the top surface 19' of the secondary member 19 or the collar member 31 as shown in FIG. 3.

The table 11 preferably includes an adjustable stop means 45 for allowing the platform member 23 to be readily moved to a desired position from the first position or one of the infinite positions. The adjustable stop means 45 preferably includes a bolt member 47 for screwably extending through the secondary member 19 and for contacting the bottom surface 17'' of the top member 17 when the top member 17 is moved to the desired position. The bolt member 47 may extend through a threaded aperture in the collar member 31 and through the aperture 29 as clearly shown in FIG. 1. The stop means 45 preferably includes a lock nut 48 threadingly mounted on the bolt member 47 for locking the bolt member 47 in a desired position as will be apparent to those skilled in the art. The bolt member 47 can be moved relative to the secondary member 19 for allowing the location of the desired position to be changed.

Figure 7:
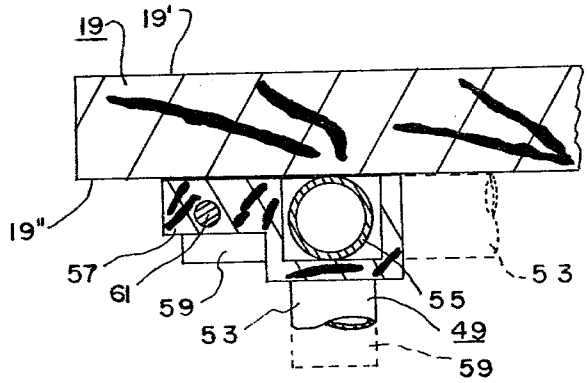
FIG. 7 is a sectional view as taken on line VII—VII of FIG. 5.
Figure 8:
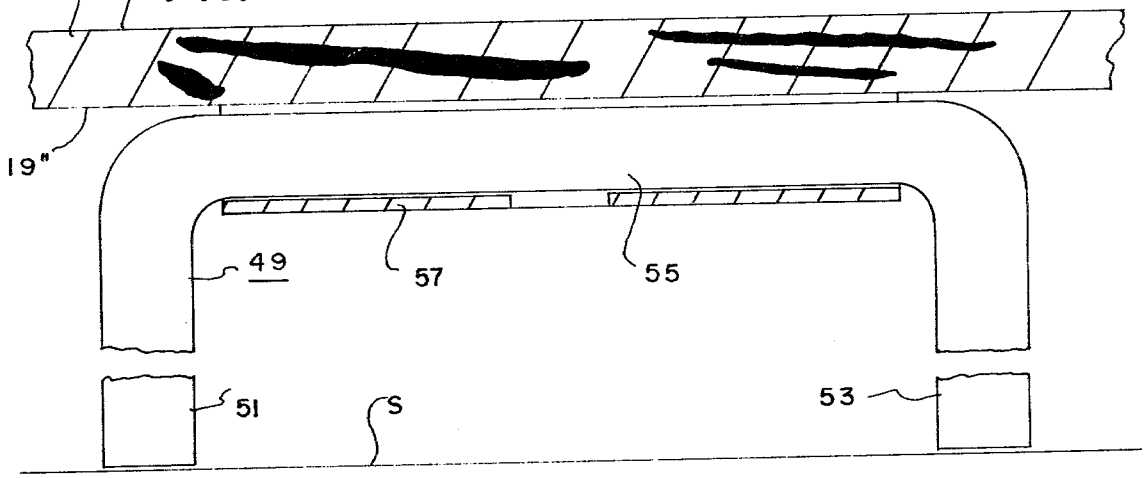
FIG. 8 is a sectional view as taken on line VIII—VIII of FIG. 1.

The table 11 preferably includes folding leg means for supporting the table 11 above a supporting surface S. The leg means includes a pair of U-shaped leg members 49. Each leg member 49 has a first leg portion 51 and a second leg portion 53 joined together at one end by a bight portion 55 (see FIG. 8). The leg means includes a coupling member 57 for pivotally coupling each of the leg members to the bottom surface 19'' of the secondary member 19. As thus pivotally coupled to the secondary member 19, each leg members 49 can pivot between a first position in which the first and second leg portion 51, 53 are substantially perpendicular to the working surface 17' of the top member 17 as shown in solid lines in FIG. 1 and a second position in which the first and second leg portions 51, 53 are substantially parallel to the working surface 17' as shown in broken lines in FIG. 1 of the top member 17. The coupling member 57 extends over a portion of the bight portion 55 of the leg members 49 to thereby pivotally couple the leg members 49 to the secondary member 19. The coupling member 57 can be fixedly attached to the bottom surface 19'' of the secondary member 19 in any manner apparent to those skilled in the art such as by screws, glue or the like. The coupling member can be constructed in any manner and of any substantially rigid material such as wood or the like as apprent to those skilled in the art. A clip member 58 may be attached to the bottom surface 19'' of the secondary member 19 to hold the leg members 49 in the second position (see, in general, FIG. 1). The clip member 58 may be constructed of spring steel or the like in a manner which allows it to selectively grasp one of the leg portions 51, 53 of one of the leg members 49 to hold that leg member 49 in the second position. Another clip member 58 may be provided to hold the other leg member 49 in the second position or the leg members 49 may be constructed so that, when in the second position, the leg portions 51, 53 of one leg member 49 overlaps the leg portions 51, 53 of the other leg member 49 whereby one clip member 58, grasping one of the leg portions 51, 53 of one leg member 49 will hold both leg members 49 in the second position in a manner which should now be apparent to those skilled in the art. The leg means preferably includes a catch means for selectively locking each of the leg members 49 in the first position. The catch means preferably includes a body member 59 fixedly attached to the bight portion 55 of the leg member 49 (see, in general, FIG. 5) for movement between a first position substantially parallel with the bottom surface 19'' of the secondary member 19 when the first and second leg portions 51, 53 are in the first position as shown in solid lines in FIG. 7 and a second position substantially perpendicular to the bottom surface 19'' of the secondary member 19 when the first and second leg portions are in the second position as shown in broken lines in FIG. 7. The catch means also includes a lock element 61 slidably attached to the secondary member 19 for lockably engaging the body member 59 when the body member 59 is in the first position (see FIG. 6). The body member 59 perferably has an aperture 63 through one side thereof. The lock element 61 is slidably positioned for movement between a first position and with a portion of the lock element 61 is positioned within the aperture 63 of the body member 59 as shown in solid lines in FIG. 6 to thereby lock the body member 59 in the first position and a second position as shown in broken lines in FIG. 6 in which the body member 59 is free to move between the first and second positions. The catch means preferably includes a spring member 65 for normally urging the lock element 61 to the first position. The lock element 61 is preferably slidably position within an opening 67 in the coupling member 57. A handle member 69 is preferably attached to the lock element 61 for allowing the lock element 61 to be manually moved from the first position to the second position. A slot 71 is provided in the coupling member 57 in communicating with the aperture 67 for allowing the handle member 69 to be moved.

Figure 2:
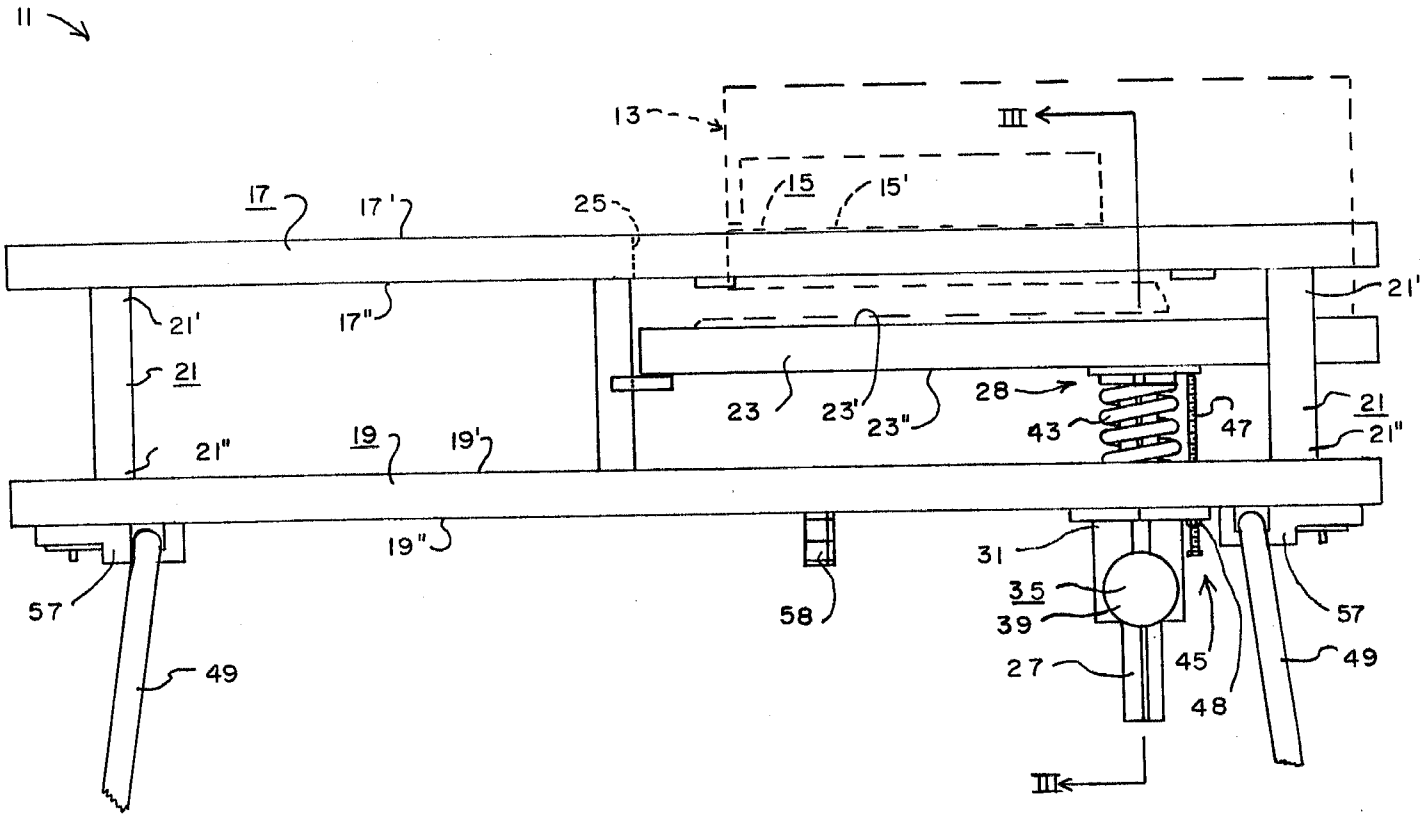
FIG. 2 is a side elevational view similar to FIG. 1 but with some components in a moved position.
Figure 10:
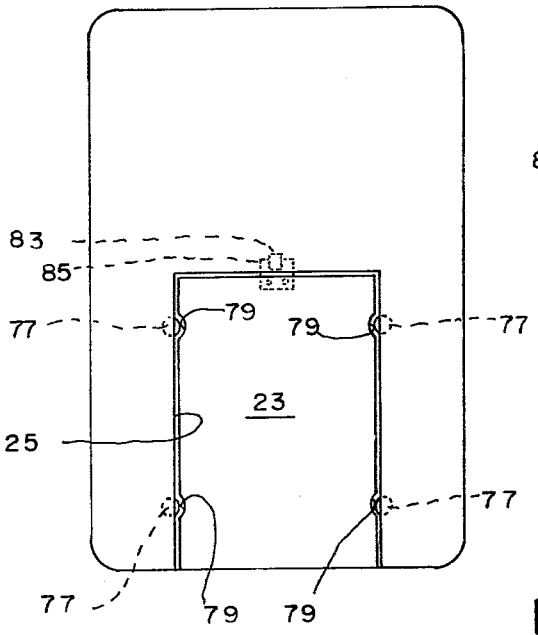
FIG. 10 is a top plan view of the table of the present invention.
Figure 13:
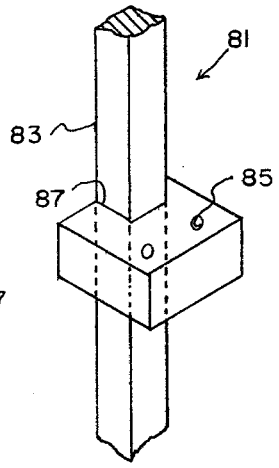
FIG. 13 is a pictorial view of a portion of the table of the present invention with some parts not shown for sake of clarity.
Figure 11:
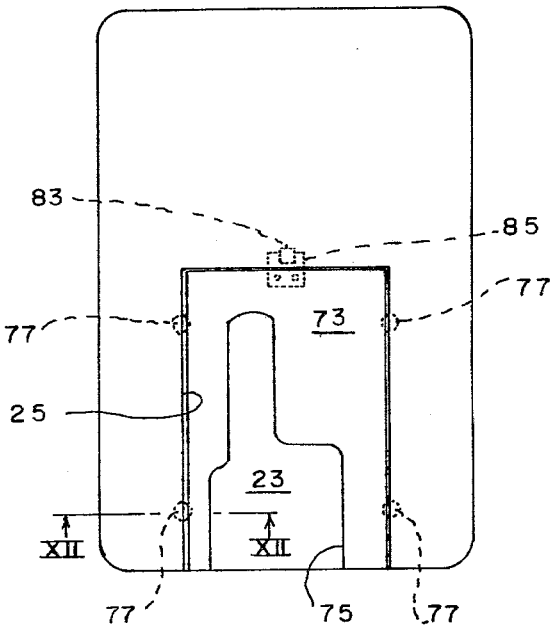
FIG. 11 is a top plan view similar to FIG. 10 but with the fill member mounted thereon.
Figure 12:
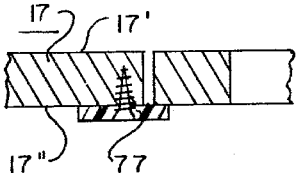
FIG. 12 is a sectional view as taken on line XII—XII of FIG. 11.

A fill member 73 may be provided to fill the area between the edge of the opening 25 in the top member 17 and the sewing machine 13 (see FIG. 9 and 11) when the top surface 23' of the platform member 23 is spaced below the top surface 17' of the top member 17 so as to provide a smooth, substantially continuous working surface when the sewing machine 13 is in a position such as shown in FIG. 2. Thus, the fill member 73 has an over-all shape and size substantially like that of the opening 25 in the top member 17 and has an opening 75 therein which is substantially the same shape and size as the cross-sectional area of the sewing machine 13 taken at a location substantially even with the top surface 17' of the top member 17 when the sewing machine 13 is in a position such as shown in FIG. 2. Lug-like members 77 may be attached to the bottom surface 13'' of the top member 13 in communication with the opening 25 for supporting the fill member 73 as shown in FIGS. 10, 11 and 12. The platform member 23 may have groove-like portions 79 therein for by-passing the lug-like members 77 (see FIG. 10).

The table 11 may include a guide means 81 for use in guiding the platform member 23 between the first and infinite positions thereof and to stablize the platform member 23. The guide means 81 may include a post-like member 83 extending between the bottom surface 17'' of the top member 17 and the top surface 19' of the secondary member 19 (see, in general, FIGS. 1 and 2). The guide means 81 may also include a collar-like member 85 for being fixedly attached to the bottom surface 23'' of the platform member 23 and for engaging the post-like member 83. More specifically, the collar-like member 85 may have a slot-like portion 87 for slidably receiving a portion of the post-like member 83 whereby up and down movement of the platform member 23 will be guided and stabilized by the guide means 81.

To use the table 11 of the present invention, an object such as the sewing machine 13 is merely placed on the platform member 23. The platform member 23 is then adjusted to properly locate the sewing machine 13 with respect of the working surface 17' of the top member 17. That is, if it is desired to do free-arm sewing with the sewing machine 13, the platform member 23 is moved to the first position with the top surface 23' substantially level or horizontally aligned with the top or working surface 17'. This is accomplished merely by loosing the hand screw member 35 whereupon the spring means 43 will urge the platform member 23 to the first position. The hand screw member 35 is then re-tightened to lock the platform member 23 in place. If it is desired to do flat-bed sewing with the sewing machine 13, the hand screw member 35 is loosened and a slight downward pressure applied to the platform member 23 until the upper surface 15' of the free-arm member 15 of the sewing machine 13 is substantially level or horizontally aligned with the top or working surface 17'. The hand screw member 35 is then re-tightened to lock the platform member 23 in place. The fill member 73 may then be inserted about the free-arm member 17. When it is desired to store the table 11, the sewing machine 13 is merely removed, the lock elements 61 moved to the unlocked positions, and the leg members 49 folded to the second postions.

Although, the invention has been described and illustrated with respect to a preferred embodiment thereof, it is not to be so limited since changes and modifications may be made in which are within the full intended scope of the invention.

I claim:

1. A table comprising:

(a) a top member having an opening therethrough;

(b) a secondary member disposed beneath said top member a spaced apart distance, said secondary member having an aperture therethrough;

(c) means for fixedly attaching said top member and said secondary member to one another;

(d) a platform member having a size and shape complementary with said opening in said top member for movement between a first position with the top surface of said platform member horizontally aligned with the top surface of said top member and numerous positions with the top surface of said platform member spaced beneath the top surface of said top member;

(e) lock means for locking said platform member in any of said first or numerous positions;

(f) spring means for urging said platform member to said first positions; and (g) alignment means for maintaining said platform member in vertical alignment with said opening in said top member, said alignment means including a post member fixedly attached to the bottom surface of said platform member and depending downwardly therefrom, said alignment means including a collar member attached to the bottom surface of said secondary member, said collar member having an aperture therethrough, said apertures through said secondary member and said collar member being aligned with one another and being slightly larger in cross sectional area than said post member to slidably receive said post member, said post member and said aperture through said collar member being substantially square in cross sectional area.

2. The table of claim 1 in which said lock means includes a hand screw member for extending through said collar member and for selectively engaging said post member to prevent said post member from moving relative to said collar member.

3. The table of claim 2 in which said spring means is positioned about said post member between the bottom surface of said top member and the top surface of said secondary member.

4. The table of claim 3 in which is included an adjustable stop means for allowing said platform member to be readily moved to a desired position from said first position or one of said numerous positions.

5. The table of claim 4 in which said adjustable stop means includes a bolt member for extending through said secondary member and for contacting the bottom surface of said top member when said top member is moved to said desired position, said bolt member being movable relative to said secondary member for allowing said desired position to be changed.

6. The table of claim 5 in which is included folding leg means for supporting said secondary member above a supporting surface, said leg means including a pair of U-shaped leg member having a first leg portion and a second leg portion joined together at one end by a bight portion, said leg means including a coupling member for pivotally coupling each of said leg members to the bottom surface of said secondary member to allow said leg member to pivot between a first position in which said first and second leg portions are substantially perpendicular to said top member and a second position in which said first and second leg portions are substantially parallel to said top member, said coupling member extending over a portion of said bight portion of said leg member to pivotally couple said leg member to the bottom surface said secondary member, said leg means including a catch means for selectively locking each of said leg member in said first position, said catch means including a body member fixedly attached to said bight portion of said leg member for movement between a first position substantially parallel with said secondary member when said first and second leg portions are in said first position and a second position substantially perpendicular to said secondary member when said first and second leg portions are in said second position, said catch means including a lock element slidably attached to said secondary member for lockably engaging said body member when said body member is in said first position.

7. The table of claim 6 in which said body member of said catch means has an aperture therein, in which said lock element of said catch means is slidably positioned within said coupling member for movement between a first position in which a portion of said lock element is positioned within said aperture of said body member to lock said body member in said first position and a second position in which said body member is free to move between said first and second positions, and in which said catch means includes a spring member for normally urging said lock element to said first position.

8. A table for supporting a free-arm sewing machine, said table comprising:

(a) a top member having an opening through which the free-arm sewing machine may freely pass;

(b) a secondary member disposed beneath said top member a spaced apart distance, said secondary member having an aperture therethrough;

(c) means for fixedly attaching said top member and said secondary member to one another;

(d) a platform member having a size and shape complemtary with said opening in said top member for bearing the free-arm sewing machine and for movement between a first position with the top surface of said platform member horizontally aligned with the top surface of said top member and numerous positions with the top surface of said platform spaced beneath the top surface of said top member;

(e) lock means for locking said platform member in any of said first or numerous positions;

(f) spring means for urging said platform member to said first position;

(g) alignment means for maintaining said platform member in vertical alignment with said opening in said top means, said alignment means including a post member fixedly attached to the bottom surface of said platform member and depending downwardly therefrom, said alignment means including a collar member attached to the bottom surface of said secondary member, said collar member having an aperture therethrough, said apertures through said secondary member and said collar member being aligned with one another and being slightly larger in cross sectional area than said post member to slidably receive said post member, said post member and said aperture through said collar member being substantially square in cross sectional area; and (h) folding leg means for supporting said secondary member above a supporting surface, said leg means including a pair of U-shaped leg members having a first leg portion and a second leg portion joined together at one end by a bight portion, said leg means including a coupling means for pivotally coupling each of said leg members to the bottom surface of said secondary member for allowing said leg members to pivot between a first position with said first and second leg portions substantially perpendicular to said top member and a second position with said first and second leg portions substantially parallel to said top member, said leg member including a catch means for selectively locking each of said leg members in said first position, said catch means including a body member fixedly attached to said bight portion of said leg member for movement between a first position substantially parallel to said top member when said leg members are in said first position and a second position substantially perpendicular to said top member when said leg members are in said second position, said catch means including a lock element slidably attached to said secondary member for lockably engaging said body member when said body member is in said first position.

* * * * *